US008128203B2

(12) United States Patent
Tori et al.

(10) Patent No.: US 8,128,203 B2
(45) Date of Patent: Mar. 6, 2012

(54) INK-JET PRINTHEAD AND MANUFACTURING METHOD THEREOF

(75) Inventors: Silvano Tori, Arnad (IT); Giancarlo Arvat, Arnad (IT); Enrico Manini, Arnad (IT); Fabio Peaquin, Arnad (IT); Claudio Pasqua, Arnad (IT)

(73) Assignee: Telecom Italia S.p.A., Milan (IT)

( * ) Notice: Subject to any disclaimer, the term of this patent is extended or adjusted under 35 U.S.C. 154(b) by 348 days.

(21) Appl. No.: 12/298,859

(22) PCT Filed: Apr. 28, 2006

(86) PCT No.: PCT/EP2006/003971

§ 371 (c)(1), (2), (4) Date: Dec. 3, 2008

(87) PCT Pub. No.: WO2007/124768

PCT Pub. Date: Nov. 8, 2007

(65) Prior Publication Data

US 2009/0195604 A1 Aug. 6, 2009

(51) Int. Cl.
*B41J 2/14* (2006.01)

(52) U.S. Cl. ..... 347/47

(58) Field of Classification Search ..... 347/40, 347/43, 47

See application file for complete search history.

(56) References Cited

U.S. PATENT DOCUMENTS 5,198,834 A 3/1993 Childers
5,278,584 A 1/1994 Keefe et al.
5,783,867 A 7/1998 Belke et al.
6,155,676 A 12/2000 Etheridge
6,315,385 B1 11/2001 Te
6,412,901 B2 * 7/2002 Su et al. ..... 347/19
6,458,472 B1 10/2002 Konarski et al.
6,467,676 B1 10/2002 Wang
6,498,260 B2 12/2002 Wang et al.
6,706,417 B2 3/2004 Konarski et al.

(Continued)

FOREIGN PATENT DOCUMENTS

EP 1136269 9/2001

(Continued)

OTHER PUBLICATIONS

International Search Report for PCT/EP2006/003971 dated Feb. 13, 2007.

*Primary Examiner* — Lamson Nguyen

(74) *Attorney, Agent, or Firm* — Venable LLP; Robert Kinberg; Steven J. Schwarz

(57) ABSTRACT

The present invention provides a process for manufacturing an ink-jet printhead comprising the steps of providing a print head wafer comprising a plurality of print head dice, each print head die comprising a nozzle plate bonded to a barrier layer formed on a substrate, wherein said plurality of print head dice are arranged on the substrate so as to define at least one first dividing channel comprising at least one first channel portion, said at least one first channel portion having a bottom portion comprised between the lateral sides of said barrier layer of at least two adjacent print head dice and an upper portion comprised between the lateral sides of said nozzle plate of said at least two adjacent print head dice, and applying an adhesive composition in an amount able to substantially fill the whole length of said at least one first channel portion.

3 Claims, 15 Drawing Sheets

U.S. PATENT DOCUMENTS

| | | | |
|---|---|---|---|
| 6,846,550 | B2 | 1/2005 | Matsumura et al. |
| 6,916,890 | B1 | 7/2005 | Woods et al. |
| 2002/0136187 | A1 | 9/2002 | Aoyama et al. |
| 2003/0207209 | A1 | 11/2003 | Patil |
| 2004/0017433 | A1 | 1/2004 | Sugiyama |

FOREIGN PATENT DOCUMENTS

| | | |
|---|---|---|
| WO | WO98/31738 | 7/1998 |
| WO | WO99/65693 | 12/1999 |
| WO | WO01/03934 | 1/2001 |

* cited by examiner

INK-JET PRINTHEAD AND MANUFACTURING METHOD THEREOF

BACKGROUND OF THE INVENTION

1. Field of the Invention

The present invention relates to an ink jet print head and a method of manufacturing thereof. More in particular, the present invention relates to method of manufacturing an ink jet print head having improved adhesion characteristics between its functional parts.

2. Description of Related Art

The present invention relates to an ink jet print head and in particular a print head of the type in which droplets of ink are expelled from a nozzle by rapid heating of a resistive element contained within an ink collecting chamber and disposed next to the nozzle.

The ink collecting chamber and the resistive element are formed within a multi-layer board realized on a silicon substrate using well known methods of construction of integrated circuits.

In short, various layers are deposited on a face of the wafer to make up the ejection resistors and the active electronic components. After that, a barrier layer of photopolymer is coated on the wafer. Using photolithographic techniques, the ejection chambers and the microidraulic conducts for the ink delivery are made in the photopolymer barrier layer and nozzle plates provided with ejection nozzles made in correspondence with the cells is mounted. A plurality of print heads, usually more than two hundreds, are made for each wafer.

A variety of different methods have been implemented in order to secure the nozzle plate to the barrier layer. These methods include but are not limited to the use of a separate layer between the orifice plate and barrier layer which contains one or more compositions that are designed to adhere these components together.

U.S. Pat. No. 5,278,584 discloses representative materials used for this purpose, which involves a number of chemical products, such as, for example uncured poly-isoprene photoresist which is applied using standard photolithographic techniques.

U.S. Pat. No. 5,198,834 describes the application of a photoresist composition sold under the name "Waycoat SC Resist 900" (Catalog No. 839167) by Olin Hunt Specialty Products, Inc. This composition is diluted with a product known as "Waycoat PF Developer" (Catalog No. 840017) and thereafter developed using "Waycoat Negative Resist Developer" (Catalog No. 837773), with both of these materials likewise being sold by Olin Hunt Specialty Products, Inc. as previously noted. Other materials which have been employed as adhesive compounds to attach the orifice plate to the barrier layer include but are not limited to polyacrylic acid, as well as acrylate and epoxy-based adhesives.

U.S. Pat. No. 6,155,676 discloses a printhead with improved durability characteristics comprising a substrate which includes an ink ejector system, a barrier layer, and an orifice plate having a bottom surface made of rhodium affixed to the barrier layer so that the rhodium-containing bottom surface is securely attached to the barrier layer. The use of rhodium in the bottom surface is described to provide improved adhesion characteristics without the use of separate adhesives.

U.S. Pat. Appl. Pub. 2003/0207209 discloses a method for making an ink jet printhead comprising applying a resin layer containing radiation curable resin formulation to a surface of a semiconductor chip containing resistive and conductive layers on the surface thereof, curing the resin layer by exposure to actinic radiation to provide a cured resin layer, aligning and attaching a nozzle plate to the semiconductor chip with an adhesive to provide a nozzle plate/chip assembly, and attaching a TAB circuit or flexible circuit to the nozzle plate/chip assembly. The resin layer provides the planarization of the surface of the chip prior to attaching the nozzle plate to the chip and at least two adhesive dots are provided on at least two diagonally opposed corners of the nozzle plate to hold the nozzle plate and the semiconductor chip in alignment.

U.S. Pat. No. 6,315,385 discloses a method for assembling a thermal ink jet printhead by applying an appropriate amount of adhesive to one or both of a nozzle plate and a barrier layer, wherein the orifice plate is provided with projections which matches with locators provided in the barrier layer to substantially hold the orifice plate and the printhead die in place to align each orifice with a corresponding transducer.

The proposed methods to secure the nozzle plate to the photopolymer barrier layer require a bonding process generally involving the application of a pressure at high temperature between the nozzle plate and the photopolymer barrier layer. Such a bonding process is generally referred as thermocompression bonding. Usually, the applied pressure ranges from 1 to 5 bar, and the temperature ranges from 150 to 200° C.

SUMMARY OF THE INVENTION

The Applicant has noticed that the thermocompression bonding between the nozzle plate, typically made of a metallic material such as nickel, and the barrier layer, typically made of a photopolymer material, coated on the silicon material substrate creates mechanical forces, due to the different coefficient of thermal expansion of the materials. The coefficient of thermal expansion of the silicon is 4 ppm/° C., while the coefficient of thermal expansion of the nickel metal usually employed for manufacturing the nozzle plate is between 15 and 20 ppm/° C., its exact value being dependent from several factors. Accordingly, the difference in the coefficient of thermal expansion between the materials is quite substantial. Consequently, the relative thermal expansion that occurs between the respective parts, in being heated from the room temperature to the curing temperature required for bonding the parts together, can cause a significant dimension mismatch that generates a mechanical stress between the wafer and the nozzle plates during and after cooling.

This mechanical stress can cause manufacturing and functional problems.

The Applicant has observed that the manufacturing problems mainly consist in the chipping of the silicon substrate during the dicing of the silicon wafer, e.g., by using a dicing saw, for separating the printheads each other. In fact, the chipping of a relatively fragile material such as the silicon is further increased by the mechanical tension between the wafer and the nozzle plates.

Further, the Applicant has observed that the functional problem mainly consists in a decreased printhead life due to the premature nozzle plate detachment favored by the tensional force generated during manufacturing.

Moreover, the Applicant has observed that the detachment of the nozzle plate may cause several problems, in particular, the entrance of air within the ejection chambers with a consequent alteration of their functionality as well as the exit of ink which causes chemical deterioration of structural parts of the whole cartridge.

Accordingly, there is still the need of improving the adhesion of the nozzle plate to avoid the above mentioned manufacturing and functional problems caused by the different coefficient of thermal expansion of the materials.

The present invention provides a process for manufacturing an ink-jet print head comprising the steps of providing a print head wafer (100) comprising a plurality of print head dice (110), each print head die (110) comprising a nozzle plate (120) bonded to a barrier layer (115) formed on a substrate (105), wherein said plurality of print head dice (110) are arranged on the substrate (105) so as to define at least one first dividing channel (135) comprising at least one first channel portion (145), said at least one first channel portion (145) having a bottom portion (160) comprised between the lateral sides (230) of said barrier layer (115) of at least two adjacent print head dice (110) and an upper portion (165) comprised between the lateral sides (200) of said nozzle plate (120) of said at least two adjacent print head dice (110), and applying an adhesive composition (170) in an amount able to substantially fill the whole length of said at least one first channel portion (145).

According to another aspect, the present invention provides for a print head die (110) comprising a nozzle plate (120) bonded to a barrier layer (115) formed on a silicon substrate (105), wherein said nozzle plate (120) comprises four lateral sides (200, 200') and said barrier layer (115) comprises four lateral sides (230, 230'), and wherein a strip (210) of adhesive composition bonds at least two opposite lateral sides (200, 200') of said nozzle plate (120) and at least two opposite lateral sides (230, 230') of said barrier layer (115) to said silicon substrate (105).

For the purpose of the present invention and of the claims enclosed herein, the expressions "bottom" and "upper" are used with reference to the orientation of the section FIGS. 5 to 8, 11 to 13 and 15 enclosed herein, wherein the substrate 105, the barrier layer 115 and the nozzle plate 120 are represented along a Z axis, substantially perpendicular to the X axis and Y axis represented in top view FIGS. 1 to 4, 9, 10 and 14 enclosed herein.

DETAILED DESCRIPTION OF THE INVENTION

Figure 1:
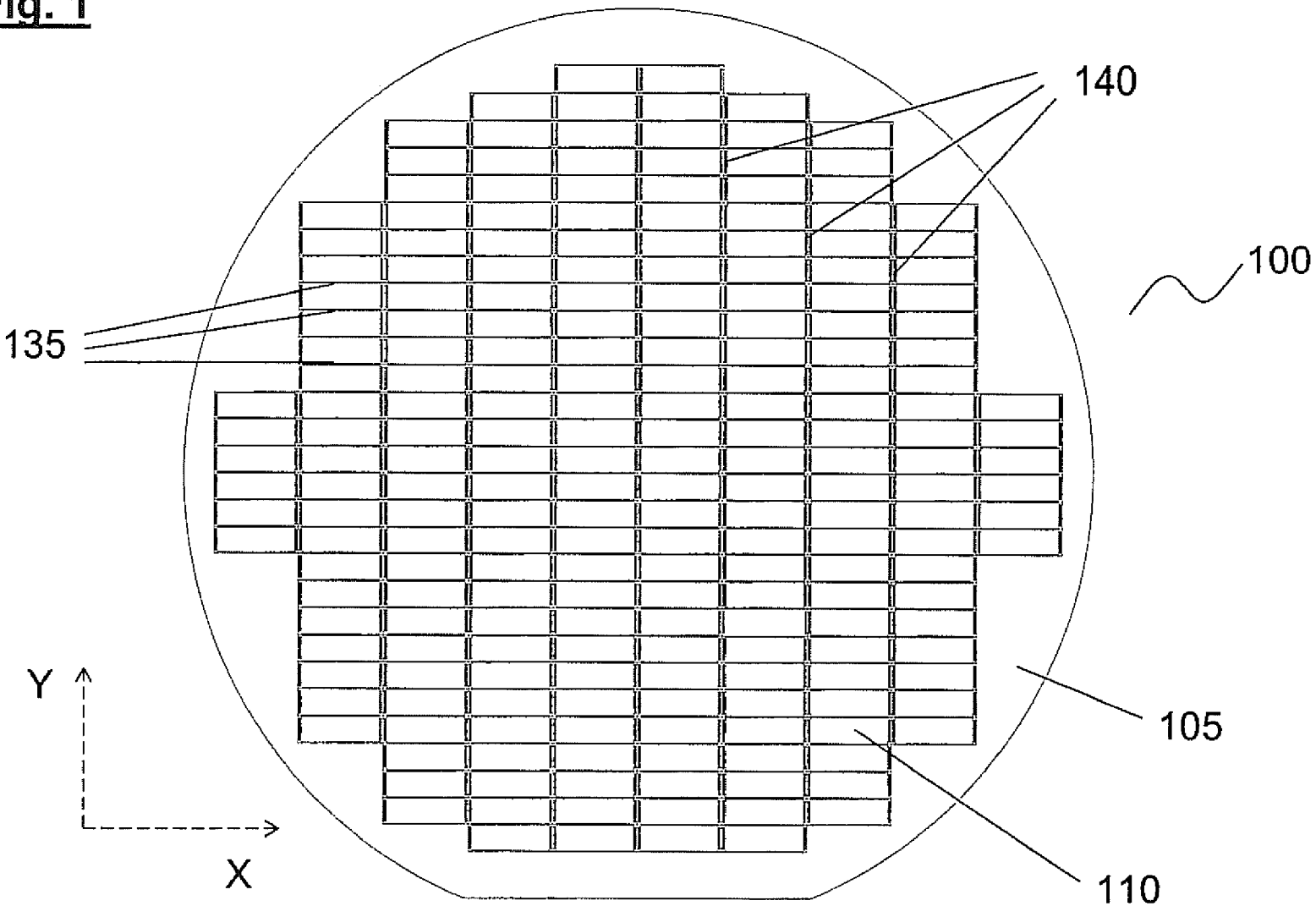
FIG. 1 is a top view of a print head wafer 100 employed in the method of the present invention.

FIG. 1 is a top view the print head wafer 100 employed in the method of the present invention. The print head wafer 100 comprises a substrate 105, preferably a silicon substrate, generally having a diameter of about 6 inches, and a typical thickness of about 600-700 μm. The print head wafer 100 comprises a plurality of print head dice 110 having a substantially rectangular shape. Preferably, the plurality of print head dice 110 are disposed on the wafer 100 in such a way that each die 110 has a first pair of lateral sides substantially aligned along a longitudinal axis X and a second pair of lateral sides substantially aligned along a transversal axis Y. The plurality of dice 110 defines along the X axis at least one first dividing channel 135, preferably a plurality of first dividing channels 135, the plurality of the first dividing channels 135 being substantially parallel each other. Moreover, the plurality of dice 110 defines along the Y axis at least one second dividing channel 140, preferably a plurality of second dividing channels 140, the plurality of the second dividing channels 140 being substantially parallel each other. The first and second dividing channels 135, 140 are substantially perpendicular each other.

Figure 2:
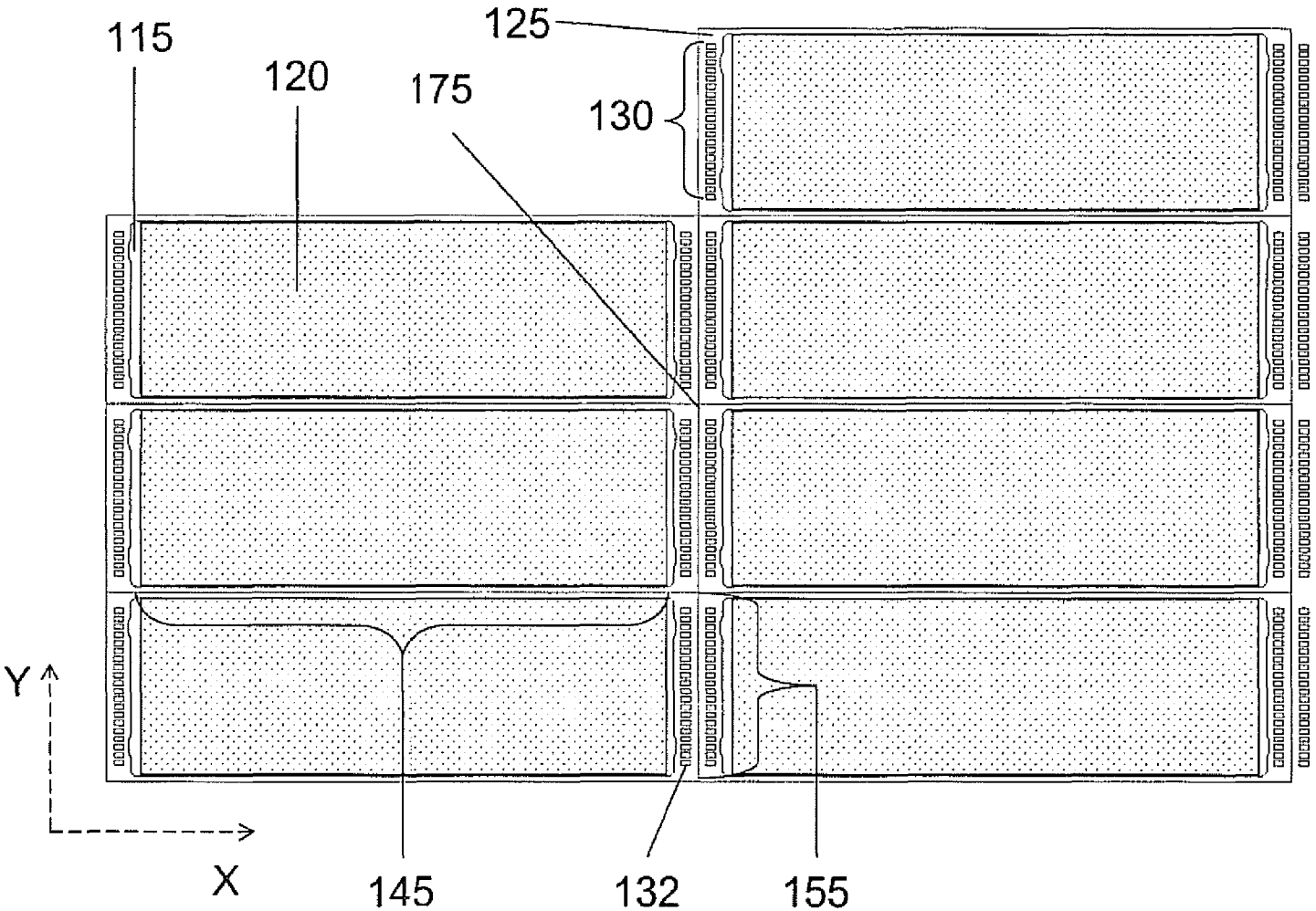
FIG. 2 is an enlargement of a portion of FIG. 1.

With reference to FIG. 2, each print head die 110 comprises a barrier layer 115 and a nozzle plate 120. Although not shown in FIG. 2, nozzle plate 120 include a plurality of nozzles, which are usually aligned in one or more rows along the X axis. In correspondence of each print head die 110, on the upper surface 125 of the substrate 105, a plurality of individually-energizable thin-film resistors (not shown), which function as "link ejectors", is realized using standard thin film fabrication techniques known in the art. The thin-film resistors are preferably fabricated from a tantalum-aluminum composition known in the art for resistor construction. Also provided on the upper surface 125 of the substrate 105 using conventional photolithographic techniques is a plurality of metallic conductive traces (e.g. circuit elements) which electrically communicate with the resistors. The conductive traces also communicate with multiple metallic pad-like contacts 132 disposed in regions 130 positioned along the short sides of each print head die 110.

The barrier layer 115 is applied on the upper surface 125 of the substrate 105 using standard deposition techniques or other methods known in the art for this purpose including but not limited to standard lamination, spin coating, roll coating, extrusion coating, curtain coating, and micromolding processes. After that, the barrier layer 115 is subjected to standard photolithographic techniques to define ink expulsion/vaporization chambers in correspondence of each ink ejector, to define the bottom portions 160, 160' (shown in FIGS. 5 and 6) of the first and the second plurality of dividing channels 135, 140, respectively, and to define the structural elements 150 (shown in FIG. 6).

The barrier layer 115 also works as a chemical and electrical insulating layer relative to the various components on the upper surface 125 of the substrate 105. Representative compounds suitable for fabricating the barrier layer 115 include but are not limited to: (1) epoxy polymers; (2) acrylic and melamine copolymers, (3) epoxy-acrylate copolymers, and (4) polyimides. However, unless otherwise indicated herein, the claimed invention shall not be restricted to any particular compounds in connection with the barrier layer 115 although materials which are generally classified as photoresists or solder-masks are preferred for this purpose. Likewise, in a non-limiting and representative embodiment, the barrier layer 115 will have a thickness of from about 5 to about 50 μm, preferably from 10 to 40 μm although this value may be varied as needed.

The barrier layer 115 may also work as bonding layer for the nozzle plate 120. Alternatively, an adhesive layer may be applied between the barrier layer and the nozzle plate. The nozzle plate 120 may be formed of a metallic material, such as, for example, a stainless steel etching plate, or a nickel-electroformed plate. Preferably, the nozzle plate 120 is a gold plated nickel electroformed plate.

The nozzle plate 120 is secured to the barrier layer 115 so that the nozzles are in precise alignment with the ink ejectors on the substrate 105 and the ink expulsion/vaporization chambers of the barrier layer 115. This is accomplished by placing the bottom surface of the nozzle plate 120 against and in physical contact with the upper face of the barrier layer 115. Specifically, the bottom surface of the nozzle plate 120 is urged toward and against the upper surface 215 of the barrier layer 115 which will self-adhere the barrier layer 115 to the nozzle plate 120 and vice versa. Preferably, the nozzle plate 120 and the barrier layer 115 are joined by thermocompression bonding method, which comprises the application of a pressure at relatively high temperature. For example, during physical engagement between the nozzle plate 120 and the barrier layer 115, both of these components are subjected (e.g. heated) to a temperature of about 160-350° C., with pressure levels of about 75-250 psi being exerted on such components. A conventional heated pressure-exerting platen apparatus may be employed for this purpose. The exact temperature and pressure levels to be selected in a given situation may be determined in accordance with routine preliminary testing taking into consideration the particular materials being used in connection with the barrier layer 115 and the nozzle plate 120.

The attachment process may take place as outlined above or instead may involve placement of the barrier layer 115 against the nozzle plate 120 if desired in accordance with the production equipment and processing facilities under consideration. In this regard, any assembly method(s) may be employed provided that, in some manner, the nozzle plate 120 and barrier layer 115 are attached together as discussed above. It should also be noted that the bottom surface of the nozzle plate 120 and/or the upper surface 215 of the barrier layer 115 are preferably cleaned in a thorough, complete, and conventional manner prior to assembly.

Figure 5:
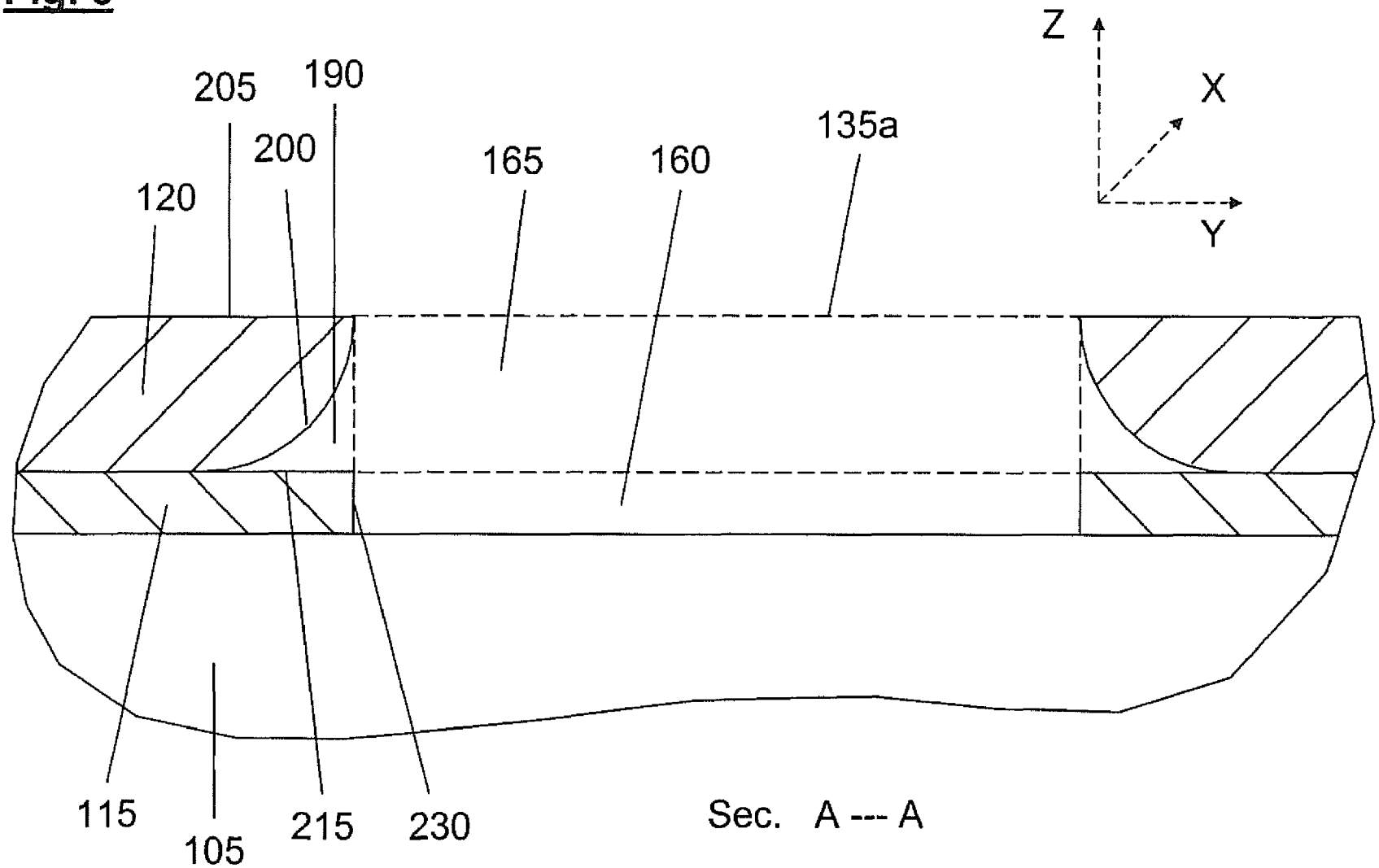
FIG. 5 is the section view A-A of FIG. 3.
Figure 6:
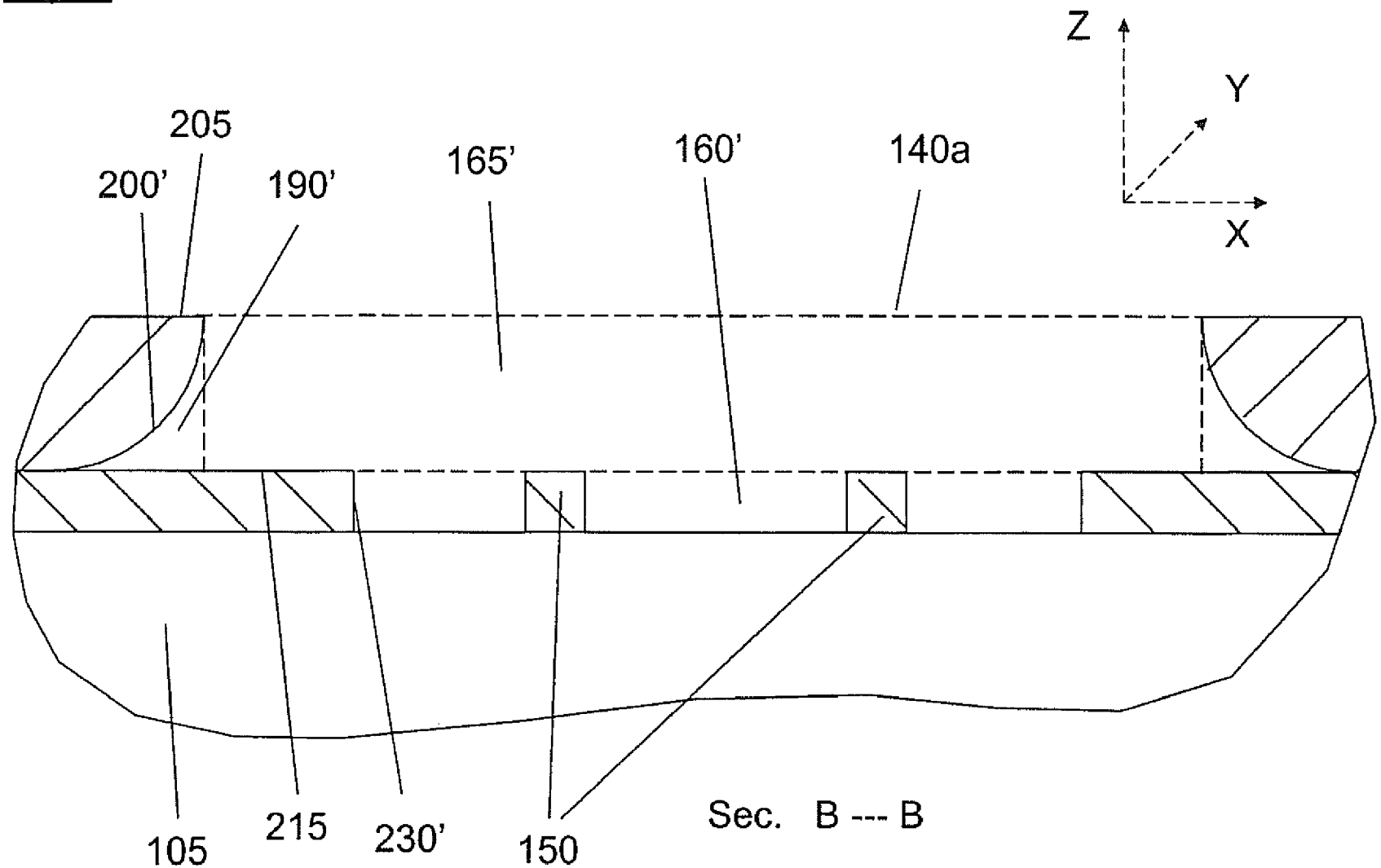
FIG. 6 is the section view B-B of FIG. 3.

The longer lateral sides 200, i.e., the sides along the X axis, of the plurality of nozzle plates 120 bonded to the barrier layer 115 define the upper portion 165 of the dividing channels 135 as shown in FIG. 5. The shorter lateral sides 200', i.e., the sides along the Y axis, of the plurality of nozzle plates 120 bonded to the barrier layer 115 define the upper portion 165' of the second dividing channels 140 as shown in FIG. 6. In a non-limiting and representative embodiment, the nozzle plate 120 will have a thickness of from 5 to 100 μm, preferably from 10 to 80 μm although this value may be varied as needed. The shape and position of the lateral sides 200, 200' of the nozzle plate 120 is not particularly limited by the shape and position described in FIGS. 5 and 6. More in particular, the edge of the upper surface 205 of the nozzle plate can be aligned along the Z axis with the edge of the upper surface 215 of the barrier layer 115 as represented in FIGS. 5 and 6 or can have a different position along the X or Y axis. In other words, the nozzle plate 120 can also be wider or narrower, i.e., relatively to Y axis, than the barrier layer 115 as well as can be shorter or longer, i.e., relatively to the X axis, than the barrier layer 115. On the other hand, the shape of the lateral sides 200, 200' of the nozzle plate 120 can have a planar shape, a convex shape, a concave shape, or an irregular shape and can form any angle with the upper surface 215 of the barrier layer 115. Preferably, the angle formed between the lateral sides 200, 200' of the nozzle plate 120 and the upper surface 215 of the barrier layer 115 is lower than 90°, more preferably lower than 75°, and most preferably lower than 60°.

As shown in FIGS. 5 and 6, a meatus 190, 190' is delimited between the lateral sides 200, 200' of the nozzle plate 120 and the portion of the upper surface 215 of the barrier layer 115 which is not covered by the nozzle plate 120. The meatus 190, 190' can extend along the whole length of the lateral sides 200, 200' of the nozzle plate 120, or can extend only for a portion thereof. According to a preferred embodiment, the meatus 190 can extend along substantially the whole length of the longer lateral sides 200, i.e., those aligned with the X axis, of the nozzle plate 120. Preferably, the meatus 190' can extend for at least 10%, more preferably at least 20%, and most preferably at least 30% of the shorter lateral sides 200', i.e., those aligned with the Y axis, of the nozzle plate 120.

As described above, the print head wafer 100 comprises a first and a second plurality of dividing channels 135, 140 oriented along the X and Y axis, respectively. In the conventional manufacturing methods, the main function of such dividing channels 135 and 140 is that of separating the print head dice each other and to define the dicing path along which a diamond wheel cuts the silicon substrate.

The first plurality of dividing channels 135 comprises a number of channels having a depth along the axis Z of from 10 μm to 150 μm, preferably from 20 μm to 120 μm, and a width of from 100 μm to 500 μm, preferably from 200 μm to 300 μm. The depth of the dividing channels 135 depends on and substantially corresponds to the sum of the height of the barrier layer 115 and the height of the nozzle plate 120. As shown in FIG. 5, the bottom surface of each channel 135 is defined by the upper surface 125 of the silicon substrate 105, while the lateral walls of each channel 135 are defined by the longer lateral sides 230 of the barrier layer 115 and by the longer lateral sides 200 of the nozzle plate 120 of each print head die 110. As represented in FIG. 2, each couple of adjacent print head dice 110 defines a first channel portion 145 comprised between their faced longer lateral sides 230, 200 (shown in FIG. 5) of the barrier layerb 115 and the nozzle plate 120 of each print head die. Accordingly, each dividing channel 135 comprises at least one first channel portion 145, preferably a plurality of first channel portions 145, disposed along the X axis.

The second plurality of dividing channels 140 comprises a number of channels having a depth of from 10 μm to 150 μm, preferably from 20 μm to 120 μm, and a width of from 500 μm to 1500 μm, preferably from 800 μm to 1200 μm. Again, the depth of the dividing channels 140 depends on and substantially corresponds to the sum of the height of the barrier layer 115 and the height of the nozzle plate 120. As shown in FIG. 6, the bottom surface of each channel is defined by the upper surface of the silicon substrate 105, while the lateral walls of each channel are defined by the shorter lateral sides 230' of the barrier layer 115 and by the shorter lateral sides 200' of the nozzle plate 120. As represented in FIG. 2, each couple of adjacent print head dice 110 defines a second channel portion 155 comprised between their faced shorter lateral sides 230', 200' (shown in FIG. 6) of the barrier layer 115 and the nozzle plate 120 of each print head die. Accordingly, each dividing channel 140 comprises at least one second channel portion 155, preferably a plurality of second channel portions 155, disposed along the Y axis.

As mentioned above, the short sides disposed along the Y axis of each print head die 110 define a region 130 comprising multiple metallic pad-like contacts 132 which allows to connect the finished print head with external driving circuits. These pad-like contacts 132 are realized on the upper surface 125 of the silicon substrate 105 and preferably have not to be covered by any additional material. Additionally, as shown in FIG. 3, the second plurality of dividing channels 140 comprises structural elements 150, the function of which will be apparent from the following description of the method of the present invention.

Figure 3:
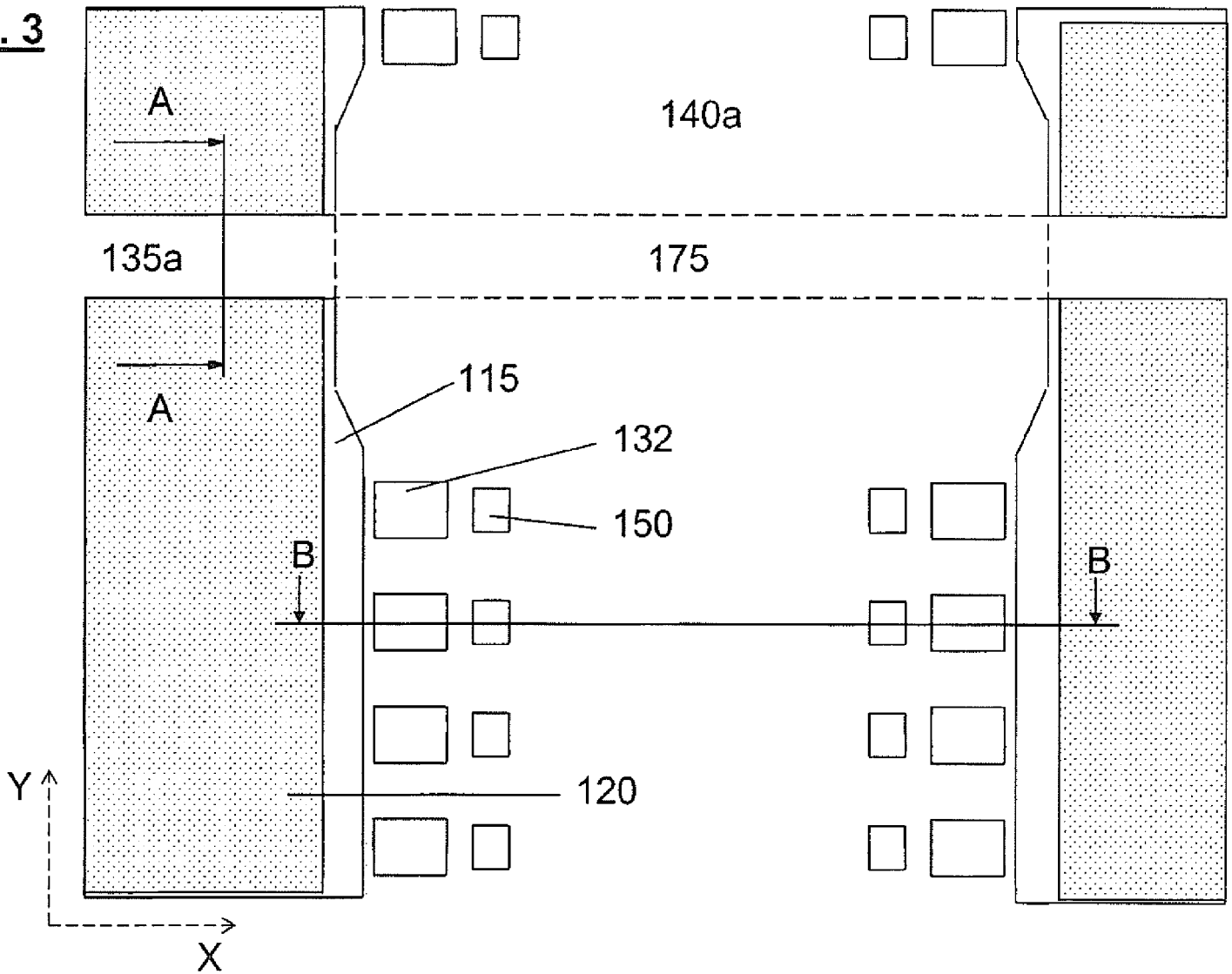
FIG. 3 is an enlargement of the area surrounding the region of inter-section 175 of FIG. 2.

FIG. 3 represents an enlargement of a portion of FIG. 2 at the intersection area 175 between a first dividing channel 135*a* and a second dividing channel 140*a*. The dashed line representing the intersection area 175 also defines the starting and ending lines of the above described first channel portions 145 as well as the starting and ending lines of the above described second channel portions 155.

The section A-A of FIG. 3 is shown in FIG. 5. As can be seen in FIG. 5, within the first dividing channel 135*a* can be distinguished a bottom portion 160 and an upper portion 165. The bottom portion 160 is delimited by two faced longer lateral sides 230 of the barrier layer 115 of two adjacent dice 110. The upper portion 165 is delimited by two faced longer lateral sides 200 of the nozzle plate 120 of two adjacent dice 110. Within the upper portion 165, a meatus 190 can be distinguished, such a meatus 190 extending along the longer sides of each print head die 110; delimited by the longer lateral sides 200 of the nozzle plate 120 and the upper surface 215 of the barrier layer 115.

The section B-B of FIG. 3 is shown in FIG. 6. As can be seen in FIG. 6, within the second dividing channel 140*a* can be distinguished a bottom portion 160' and an upper portion 165'. The bottom portion 160' is delimited by two faced shorter lateral sides 230' of the barrier layer 115 of two adjacent dice 110 and comprises within it the structural elements 150, which preferably has the same height as the barrier layer 115. The upper portion 165' is delimited by two faced shorter lateral sides 200' of the nozzle plate 120 of two adjacent dice 110. Within the upper portion 165', a meatus 190' can be distinguished, such a meatus 190' extending along the shorter side of each print head die 110, delimited by the shorter lateral sides 200' of the nozzle plate 120 and the upper surface 215 of the barrier layer 115.

Figure 9:
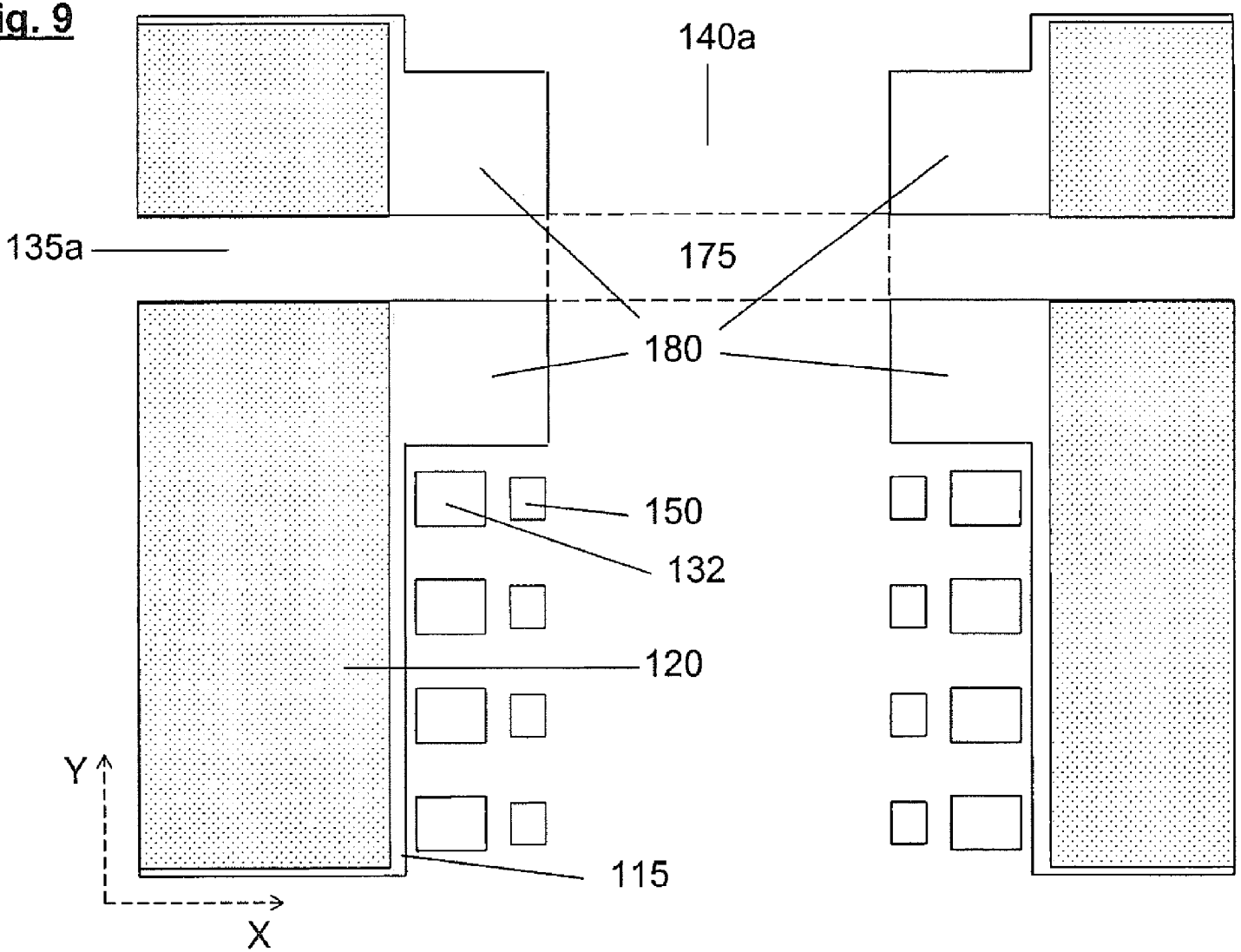
FIG. 9 is an enlargement of the area surrounding the region of intersection 175 of a print head wafer 100 used in an alternative embodiment of the present invention.

According to an alternative embodiment of the present invention, as shown in FIG. 9, the ending corner 180 of the barrier layer 115 is prolonged along the X axis so that to extend the bottom portion 160 of the first channel portion 145 of each pair of faced print head dice 105 and to reduce the area of the intersection 175 between the first plurality of dividing channels 135 and the second plurality of dividing channels 140. According to this embodiment, the width of the second plurality of dividing channels 140 is also reduced.

According to the method of the present invention, the adhesive composition 170 is deposited to substantially fill the whole length of said first channel portion 145. According to a preferred aspect of the method of the present invention, the adhesive composition 170 is deposited to substantially fill the whole length of said plurality of dividing channels 135. The term "substantially fill the whole length" means that the adhesive composition 170 fills at least 80%, preferably at least 85%, more preferably at least 90%, and most preferably at least 95% of the whole length under consideration, i.e., the length of the first channel portion 145 or the length of the first plurality of dividing channels 135.

The adhesive composition 170 suitable in the method of the present invention preferably has a viscosity at the working temperature which enables the adhesive composition 170 to flow by capillary action through the dividing channels 135. The viscosity of the adhesive composition 170, measured with the Brookfield method and apparatus, is preferably lower than 50,000 cp, most preferably lower than 20,000 cp, and most preferably lower than 5,000 cp at 25° C. The most preferred range of viscosity usually ranges from 500 to 4,000 cp at 25° C. If the viscosity of the adhesive composition 170 is too high the flow by capillary action within the channels is too slow or completely absent.

The adhesive composition 170 suitable in the method of the present invention preferably has a pot life able to maintain the adhesive composition 170 in the uncured status and without any substantial increase of the viscosity value for the whole time needed for the deposition of the method of the present invention. The wording "without any substantial increase of the viscosity value" is meant that the increase is lower than 10%, preferably lower than 5%. The "pot life" is known in the art as the period of time that an adhesive composition retains a viscosity low enough to be used in processing. The pot life of the adhesive composition 170 is preferably higher than 6 hours, most preferably higher than 12 hours, and most preferably higher than 24 hours at 40° C.

Additionally, in order to reduce mechanical stress, the adhesive composition 170 suitable in the method of the present invention preferably has a modulus of elasticity lower than about 3,500 MPa and an elongation at break of at least 30%, preferably of at least 40%.

The adhesive compositions 170 useful in the method of the present invention can be preferably selected from mono- or di-component adhesive compositions. Mono- or di-component adhesive compositions can be chosen among self-curing adhesive compositions or requiring exposure to heat or to electromagnetic radiations (such as, for example, UV radiations) to cure. Preferred adhesive compositions 170 suitable for the method of the present invention are mono-component curable epoxy adhesive compositions. Suitable examples of such adhesive compositions are represented by epoxy adhesive compositions which include epoxy resins distributed under the trade name E 1216, XE1218, E 1172A, E 151-8, E 1070 by Emerson & Cuming, a Company of the National Starch and Chemical Group, USA, or under the trade name Delo-Dualbond DB707, by Delo Industrial Adhesives, Germany, or under the trade name EPON by Resolution Performance Products Co. USA, or under the trade name ARALDITE by Huntsman Advanced Materials Co., USA, or under the trade name DER by Dow Chemical Co., USA, or under the trade name CP7135, CP7130, ESP7450, MEE7650, MEE7650-5 and MEE7850 by Al Technology. Underfill adhesive composition distributed by NAMICS Corporation, Japan, under the code U8437-2, U8439-1, U8410-11, U8443, U8449, 8422, 8408, 84354, 8462-21, 8462-96 are also useful for the purpose of the present invention.

Useful examples of underfill curable adhesive composition to be used in the method of the present invention are described in U.S. Pat. Nos. 5,783,867, 6,846,550, 6,916,890, 6,706,417, 6,498,260, 6,467,676, 6,458,472, and international Application WO9831738.

The deposition of the adhesive composition is made after the nozzle plate 120 is secured to the barrier layer 115. Any method known in the art can be used to deposit the adhesive composition 170. According to a preferred method, the adhesive composition 170 is deposited by means of a syringe operated by an automatic apparatus controlled by a positioning software according to conventional methods known in the art. Preferably, the syringe deposits a predetermined amount of adhesive composition 170 within each first channel portion 145. In order to increase the speed of the capillary flow and to reduce the mechanical stress, the deposition is preferably made after having heated the print head wafer 100 at a temperature of from 40° to 80° C., more preferably from 50° to 70° C.

Figure 4:
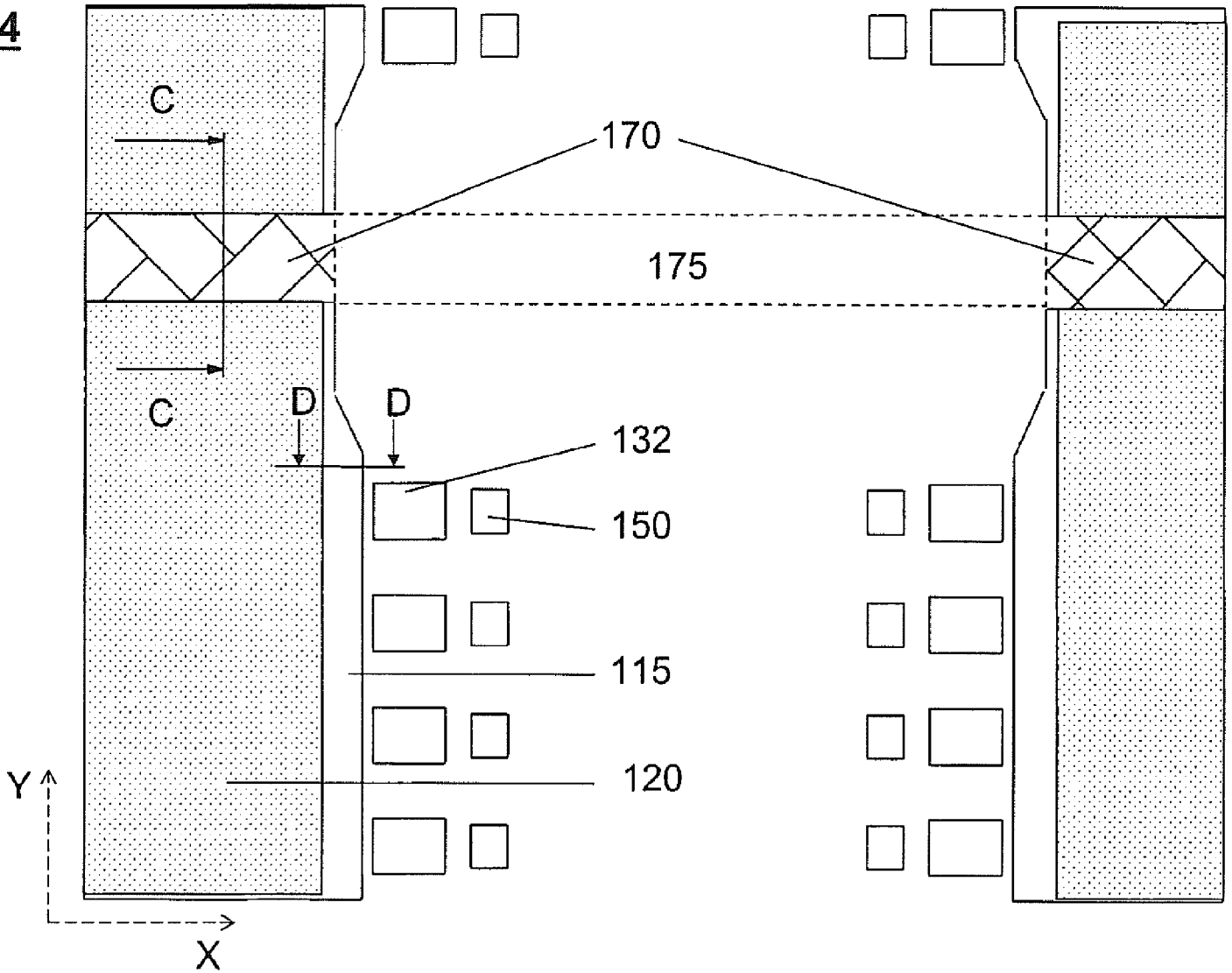
FIG. 4 represents the same area of FIG. 3 after deposition of the adhesive composition 170.

According to a preferred aspect of the method of the present invention the adhesive composition 170 is applied along a length L lower than the whole length of the first channel portion 145, said length L being preferably from 40 to 95%, more preferably from 50 to 85%, and most preferably from 60 to 75% relative to the length of the first channel portion 145. The deposited amount of adhesive composition 170 flows by capillary action along the whole length of the first channel portion 145 and reaches the region of intersection 175, identified by the dashed line in FIG. 4, with the second plurality of substantially parallel dividing channels 140. The region of intersection 175 realizes a discontinuity of the capillary channel by increasing the width of the capillary channel thereby reducing the capillary force. The reduction of the capillary force stops the flow of the adhesive composition 170 which remains limited to the end edge of the barrier layer 115 as shown in FIG. 4.

Figure 8:
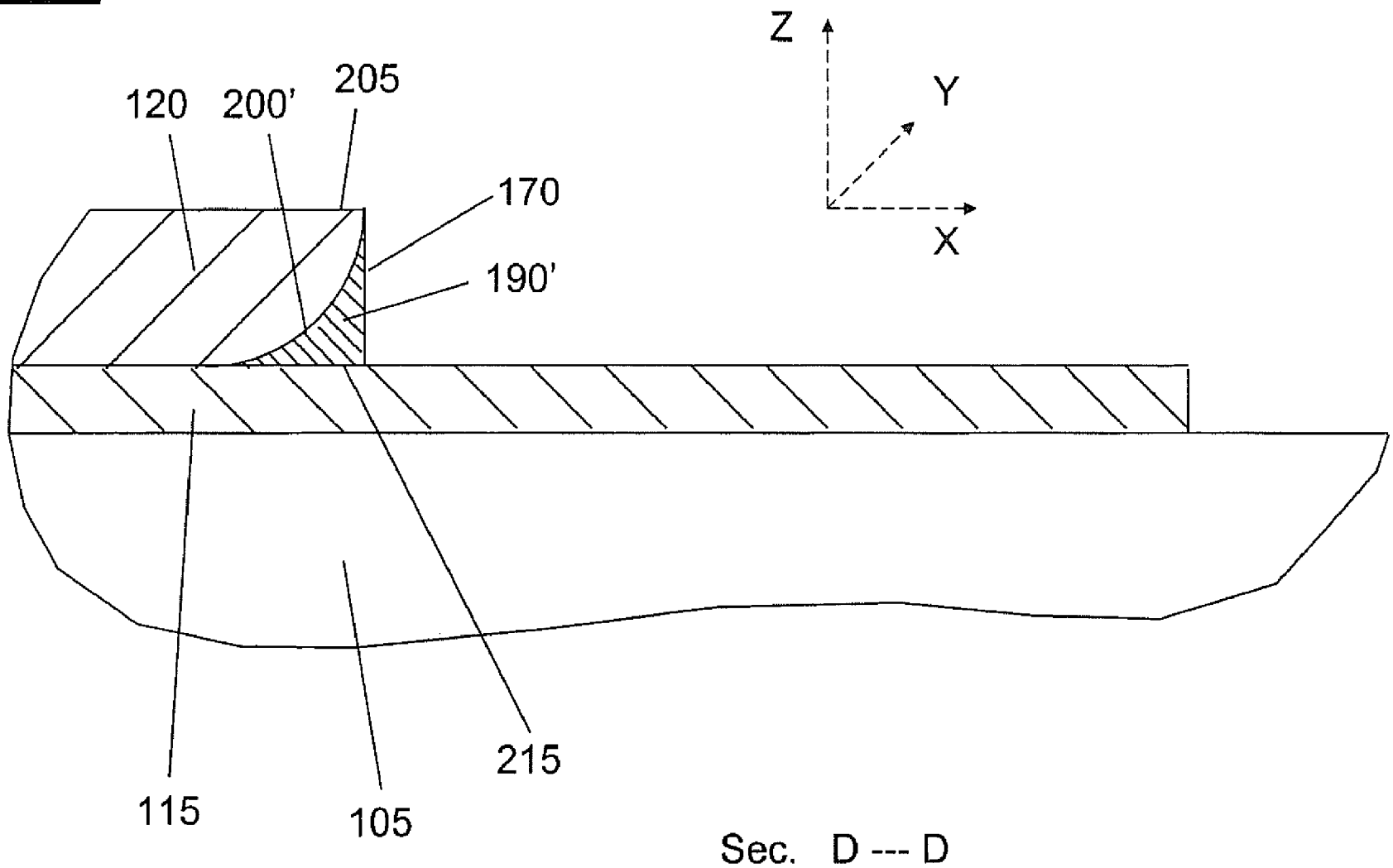
FIG. 8 is the section view D-D of FIG. 4.

However, according to a preferred embodiment of the present invention as shown by the section D-D of FIG. 8, the adhesive composition 170 continues to flow along the shorter side of the print head die 110 within the meatus 190' between the shorter lateral side 200' of the nozzle plate 120 and the upper surface 215 of the barrier layer 115 in view of the capillary force created within such a meatus 190'. The flow of the adhesive composition 170 within the meatus 190' allows to fill the meatus 190' between the shorter lateral sides 200' of the nozzle plate 120 and the surface of the barrier layer 115. For the purpose of the present invention, the meatus 190 preferably extends along the whole length of the longer lateral sides 200 of the nozzle plate 120 and the meatus 190' preferably extends for at least 10%, more preferably at least 20%, and still more preferably at least 30% the whole length of the shorter lateral sides 200' of the nozzle plate 120.

Figure 7:
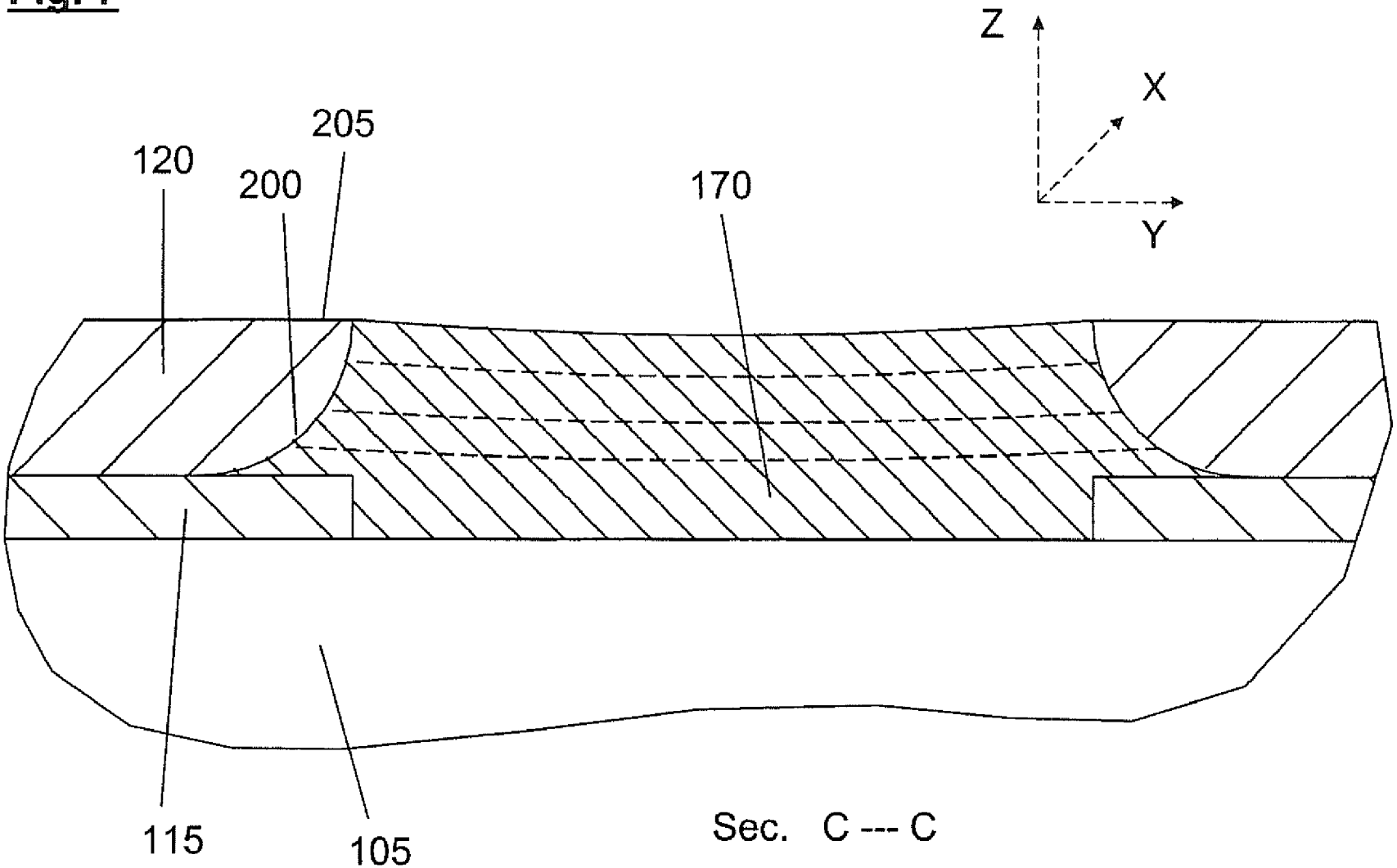
FIG. 7 is the section view C-C of FIG. 4.

As shown by the section C-C of FIG. 7, the adhesive composition 170 preferably fills the whole volume of the bottom portion 160 and the upper portion 165 of the first channel portion 145. However, the dashed lines represent alternative embodiments of the method of the present invention wherein the adhesive composition 170 fills the whole volume of the bottom portion 160 and at least 10%, preferably at least 20%, more preferably at least 40% and most preferably at least 80% of the volume of the upper portion 165 and of the meatus 190.

Figure 10:
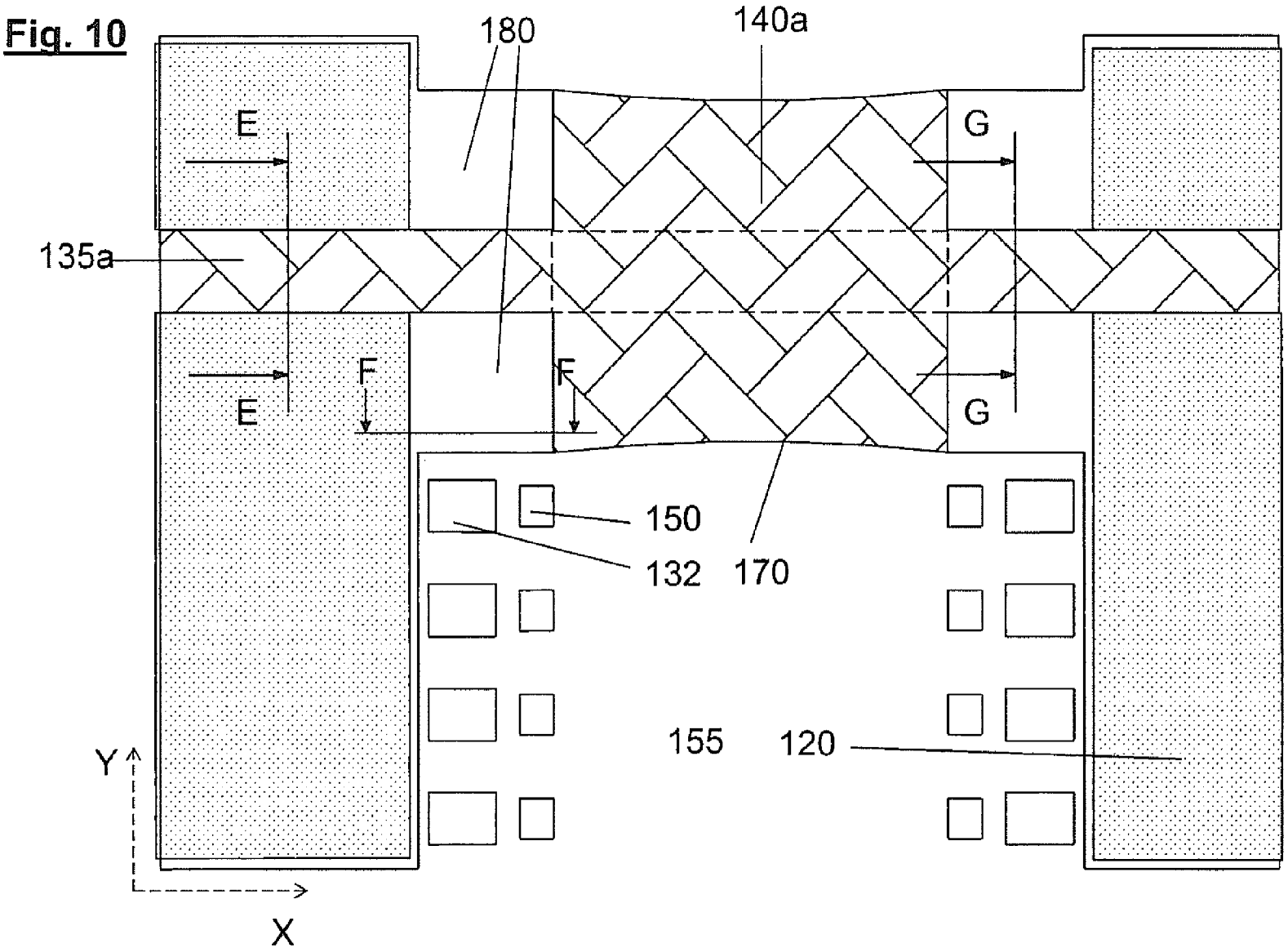
FIG. 10 represents the same area of FIG. 9 after deposition of the adhesive composition 170.

According to the alternative embodiment of the present invention and with reference to FIG. 10, the adhesive composition 170 is able to flow by capillary action between the elongations 180 of the barrier layer 115 and then to also flow in the second plurality of dividing channels 140 until to reach the discontinuity of the channels realized by the structural elements 150 which stops the capillary flow and prevents the multiple metallic pad-like contacts 132 to be covered by the adhesive composition 170. The structural elements 150 realize a discontinuity of the capillary channel by increasing the width of the capillary channel so reducing the capillary force. The reduction of the capillary force stops the flow of the adhesive composition 170 which remains limited to a part of the second channel portions 155 of the second dividing channels 140*a* interposed between the intersection with the corresponding first dividing channel 135*a* and the structural elements 150. The length of such a part of the second channel portions 155 is preferably lower than 15%, more preferably lower than 10%, and most preferably lower 5% the length of the second channel portions 155.

Figure 11:
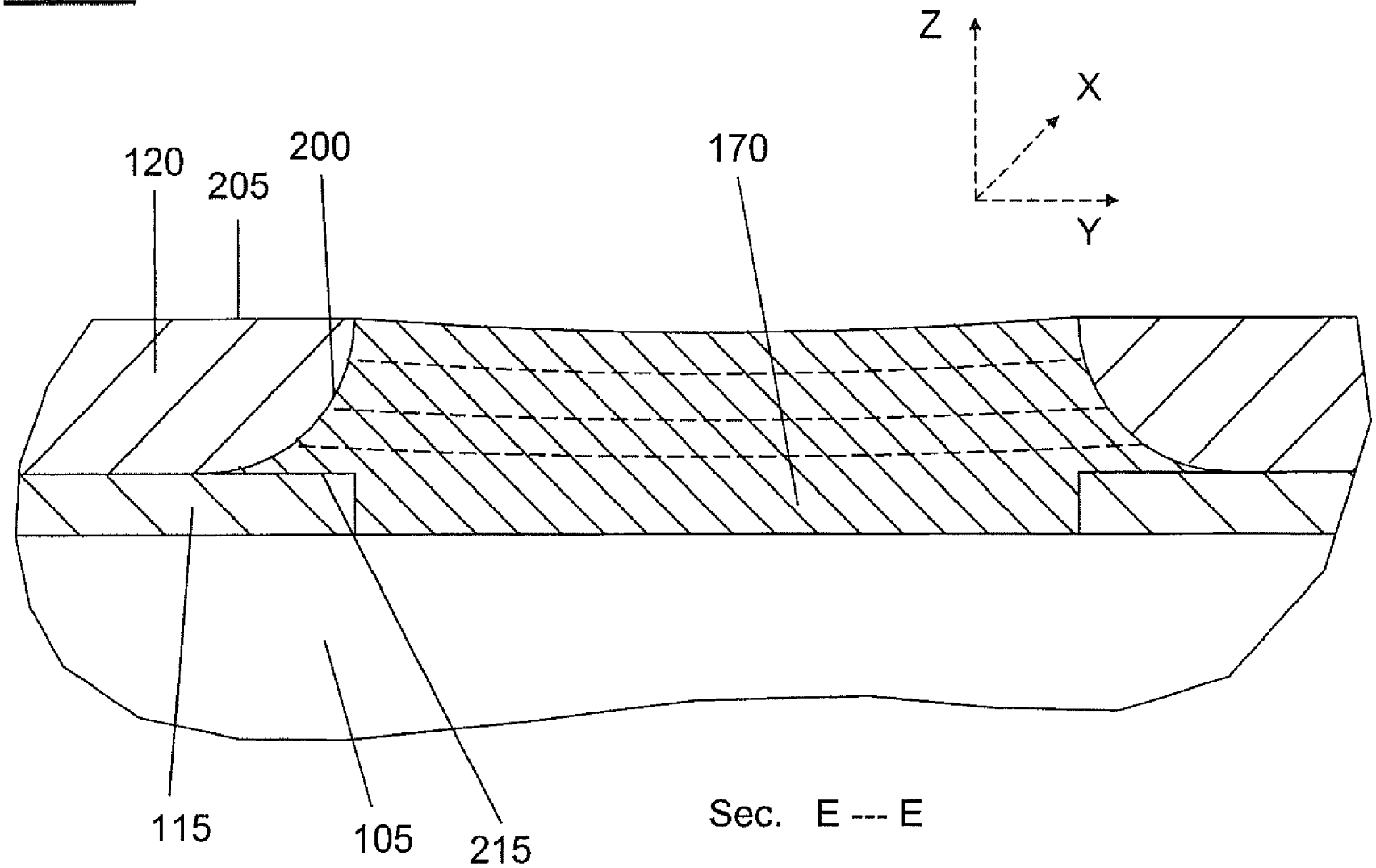
FIG. 11 is the section view E-E of FIG. 10.

FIG. 11 shows that the section E-E of the embodiment of FIG. 10 is substantially identical to section C-C of FIG. 4.

Figure 12:
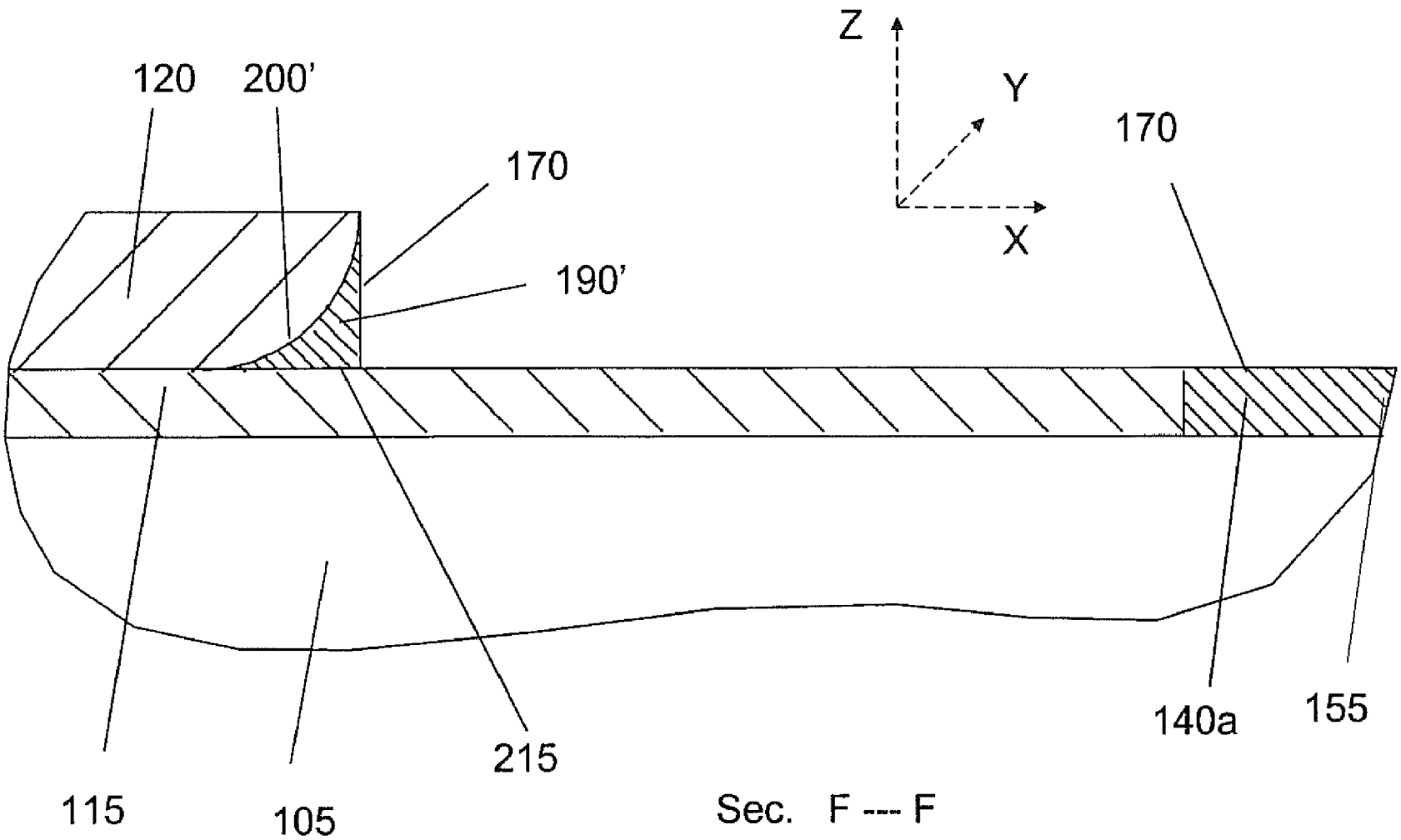
FIG. 12 is the section view F-F of FIG. 10.

FIG. 12 shows that the adhesive composition 170 flows along at least a portion of the shorter side of the print head die 110 within the meatus 190' between the shorter lateral sides 200' of the nozzle plate and the surface 215 of the barrier layer 115. FIG. 12 also shows the part of the second channel portions 155 within the second plurality of dividing channels 140 filled by the adhesive composition 170.

Figure 13:
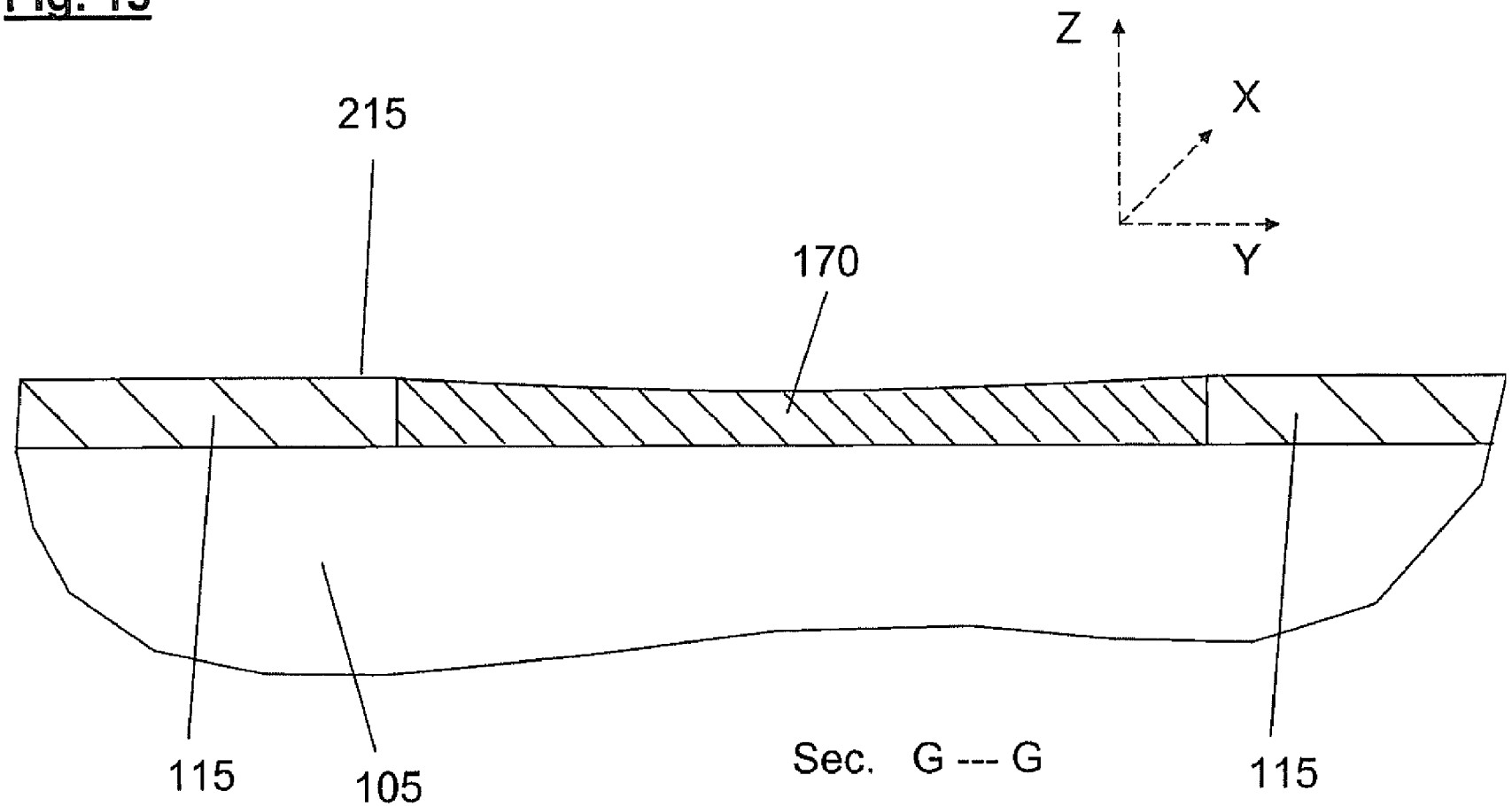
FIG. 13 is the section view G-G of FIG. 10.

The section G-G of FIG. 13 shows the portion of the first plurality of dividing channels 135 filled by the adhesive composition 170 in correspondence of the elongations 180 of the barrier layer 115.

The amount of adhesive composition 170 deposited in each channel portion 145 depends on the volume of the channel to be filled. This in turn depends on (1) the length, width and depth of the first channel portions 145, which depend on the manufacturing specifications relative to the dimensions of each print head die 110 and its main functional elements (barrier layer 115 and nozzle plate 120) as well as their disposition on the silicon substrate 105, (2) the length, width and depth of the meatus 190' along the shorter side of each print head die 110, and, (3) in case of the alternative embodiment described with reference to FIG. 9, the length, width and depth of the part of the second channel portions 155, which again depend from the manufacturing specifications relative to the dimensions of each print head die 110 and its main functional elements (barrier layer 115 and multiple metallic pad-like contact regions 130) as well as their disposition on the silicon substrate 105.

Preferably, the amount of deposited adhesive composition 170 in each channel portion 145 is comprised in the range of from 0.01 mg to 1.00 mg, more preferably of from 0.05 mg to 0.50 mg, and most preferably of from 0.10 mg to 0.20 mg.

In any case, the amount of deposited adhesive composition 170 is such as to fill at least the spaces between the dice as described above. Overfill should be preferably avoided, so as to avoid the formation of a convex surface protruding over the upper surface 205 of the nozzle plate 120 and the spilling of adhesive composition 170 on the upper surface 205 of the plurality of the nozzle plates 120.

Preferably, the deposited amount of adhesive composition 170 is such as to get a planar or concave surface of the adhesive composition 170. The amount of deposited adhesive composition 170 is at least sufficient to fill the whole volume of the bottom portion 160 of the plurality of first channel portions 145 and to fill at least 10%, preferably at least 20%, more preferably at least 40% and most preferably at least 80% of the volume of the upper portion 165 of the plurality of first channel portions 145 and of the meatus 190' along the short sides of each print head die so as to create an adhesive bonding among the lateral sides 200, 200' of the nozzle plate 120, the lateral sides 230, 230' and upper surface 215 (within the meatus 190, 190') of the barrier layer 115, and the upper surface 125 of the silicon substrate 105.

After deposition, the adhesive composition 170 is cured. In case of self curing adhesive composition, the print head wafer 100 is left at room temperature for the period of time required by the specifications of the self-curing adhesive composition. In case of curable adhesive composition the print head wafer 100 is exposed to UV light having wavelength of from 250 to 400 nm or to heat depending on the kind of curable adhesive composition 170. The thermal curing is preferably made by subjecting the curable adhesive composition to a temperature of from 50° to 150° for a period of time of from 1 to 60 minutes, taking into consideration that the higher the temperature, the lower the curing time. For example, typical thermal curing treatments include subjecting the thermal curable adhesive composition to a temperature of 100° C. for 20 minutes, or 110° C. for 10 minutes, or 125° C. for 6 minutes.

After completion of the curing, the wafer is cut by means of conventional methods known in the art, such as, for example, by means of a dicing blade, typically in the form of a circular saw, made of nickel or resin having diamond particles suspended therein. The dicing blade usually comprises an abrasive surface on both the main surface and the edges thereof. Usually, the dicing blade is approximately 80 μm thick. The dicing blade is applied along both the first and a second plurality of substantially parallel dividing channels 135, 140 after having adhered the wafer to an adhesive tape able to retain each single print head die 110 formed at the end of the cutting operation.

Figure 14:
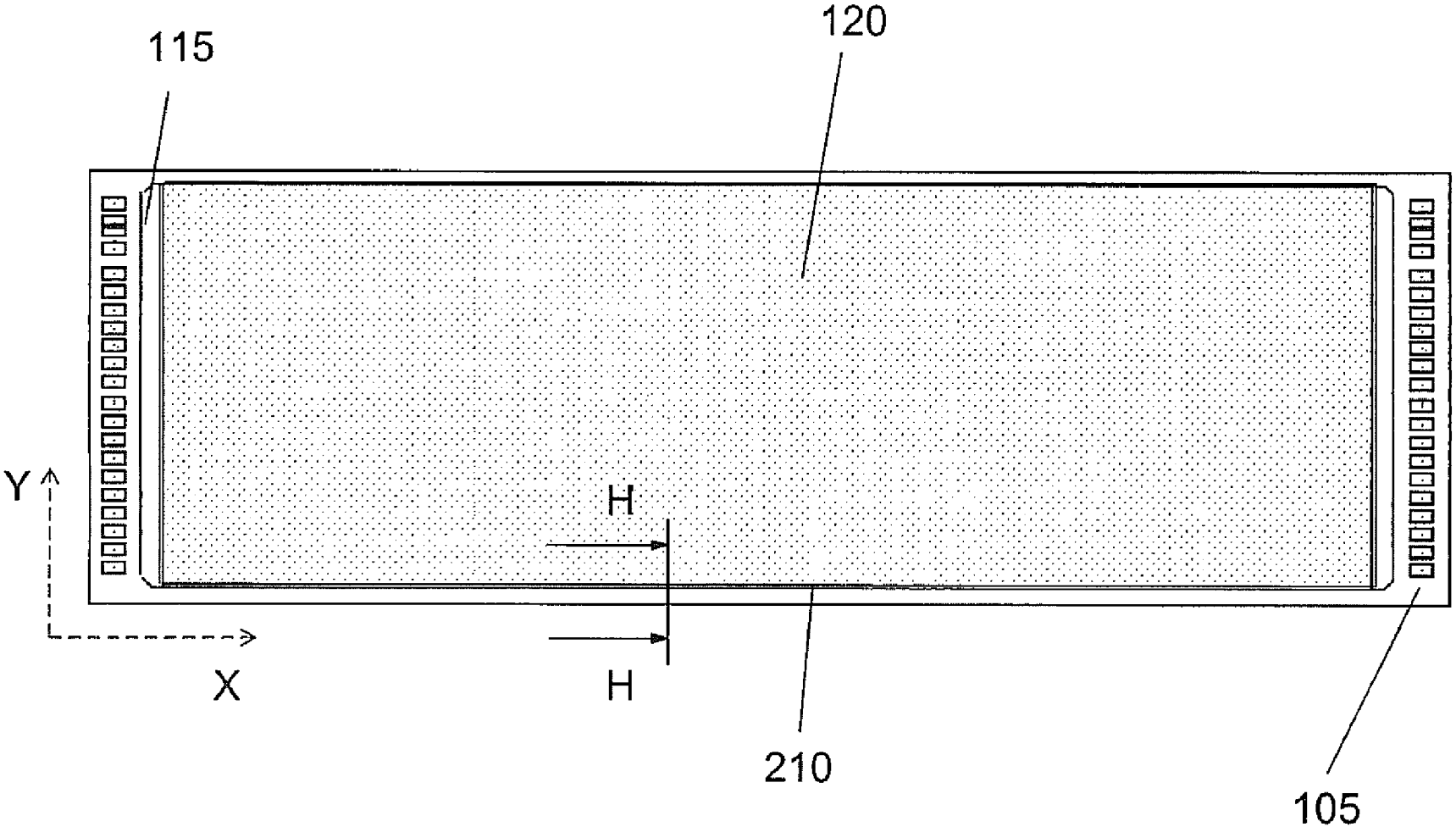
FIG. 14 is the top view of a print head die 110 obtained with the method of the present invention.
Figure 15:
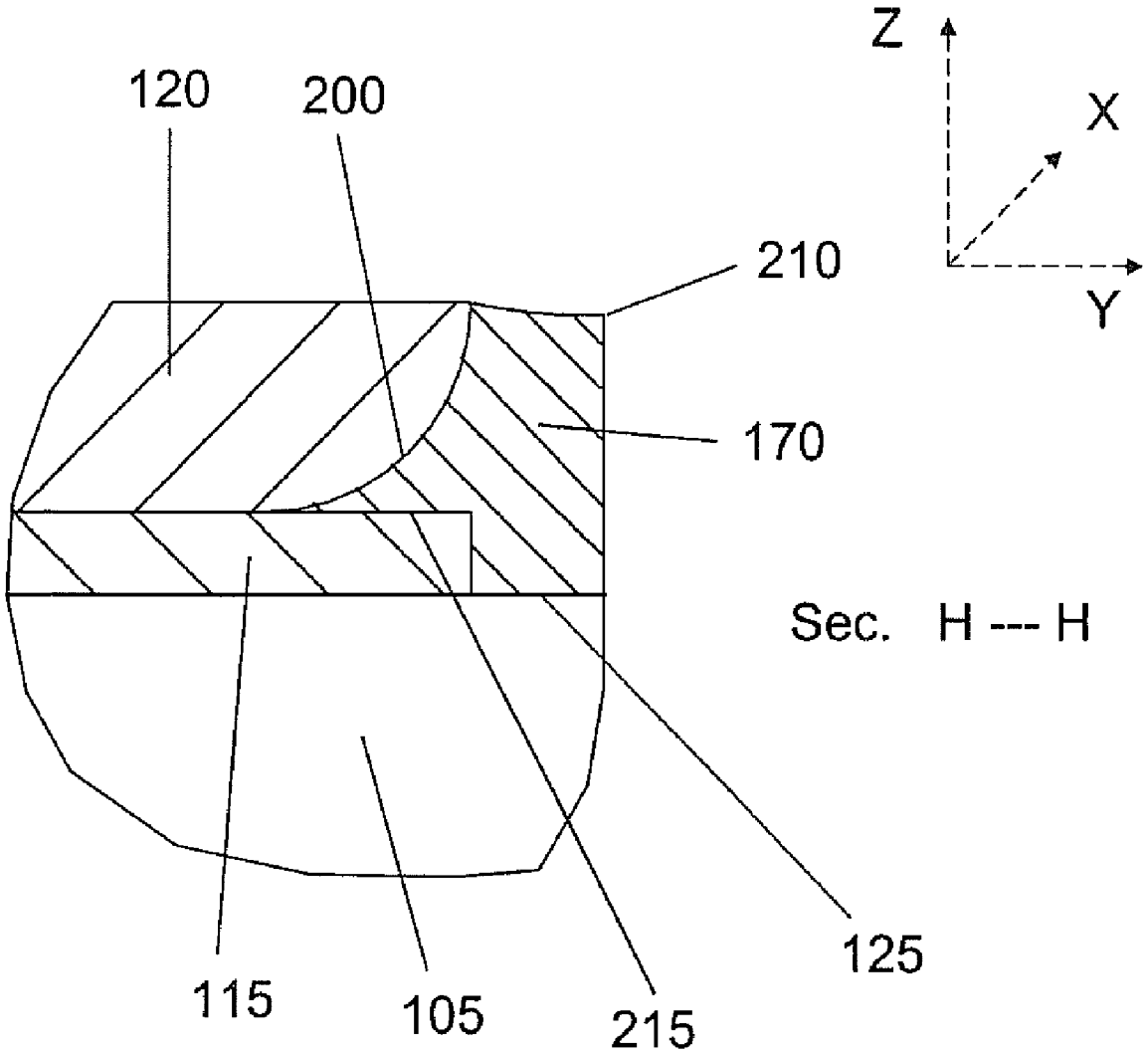
FIG. 15 is the section view H-H of FIG. 14.

FIG. 14 shows the print head die 110 obtained at the end of the dicing operation and FIG. 15 shows the section H-H of FIG. 14. The method of the present invention allows to obtain a print head die 110 having at least two opposite lateral sides 200, 200' of the nozzle plate 120 bonded to the upper surface 215 of the barrier layer 115 and to the upper surface 125 of the substrate 105 by a strip 210 of cured adhesive composition 170 (represented by the bold line in FIG. 14). For the purpose of the present invention, the strip 210 of cured adhesive composition preferably extends along the whole length of the longer lateral sides 200 of the nozzle plate 120 and for at least 10%, more preferably at least 20%, and still more preferably at least 30% the whole length of the shorter lateral sides 200' of the nozzle plate 120. Along the longer lateral sides of the print head die 110 the strip 210 of cured adhesive composition 170 extends to reach the upper surface 125 of the substrate 105 so realizing a strong bond between the main structural elements of the print head die 110, namely the nozzle plate 120, the barrier layer 115 and the silicon substrate 105, and avoiding the partial detachment of the nozzle plate 120 from the barrier layer 115. Also, along the shorter lateral sides of the print head die 110 the strip 210 of cured adhesive composition 170 advantageously provides a strong bond between the lateral sides 200 of the nozzle plate 120 and the surface 215 of the barrier layer 115 thereby further securing the nozzle plate 120 and reducing the risk of partial detachment.

The invention claimed is:

1. A print head die comprising a nozzle plate bonded to a barrier layer formed on a silicon substrate, wherein said nozzle plate of said die comprises four lateral sides and said barrier layer of said die comprises four lateral sides, and wherein a strip of adhesive composition laterally bonds at least two opposite lateral sides of said nozzle plate and of said barrier layer to said silicon substrate.

2. The print head die of claim 1, wherein at least two opposite lateral sides of said nozzle plate and the surface of said barrier layer define a meatus, and wherein said strip of adhesive composition fills said meatus.

3. The print head die of claim 1, wherein said four lateral sides of said nozzle plate and the surface of said barrier layer define a meatus, and wherein said strip of adhesive composition fills said meatus.

* * * * *